US007493664B2

(12) United States Patent
Riccobon

(10) Patent No.: US 7,493,664 B2
(45) Date of Patent: Feb. 24, 2009

(54) COMBINATION TOILET AND BIDET

(76) Inventor: Paul Riccobon, 2041 Virazon Dr., La Habra Heights, CA (US) 90631

( * ) Notice: Subject to any disclaimer, the term of this patent is extended or adjusted under 35 U.S.C. 154(b) by 0 days.

(21) Appl. No.: 12/032,654

(22) Filed: Feb. 16, 2008

(65) Prior Publication Data

US 2008/0134424 A1 Jun. 12, 2008

Related U.S. Application Data

(63) Continuation-in-part of application No. 11/138,822, filed on May 25, 2005, now abandoned.

(51) Int. Cl.
*A47K 3/20* (2006.01)

(52) U.S. Cl. ..... 4/420.4

(58) Field of Classification Search ..... 4/420.1–420.5, 4/443–448

See application file for complete search history.

(56) References Cited

U.S. PATENT DOCUMENTS 1,091,499 A 3/1914 Friedman
1,957,625 A 5/1934 Brannan
1,990,578 A * 2/1935 Zorraquin ..... 4/420.5
4,551,867 A 11/1985 Gurevich et al.
5,097,539 A 3/1992 Tchorbadjian
5,271,104 A 12/1993 La Tora
5,504,948 A 4/1996 Chandler
5,570,479 A 11/1996 Chomik et al.
5,647,069 A 7/1997 Han
5,652,971 A 8/1997 Wokas
5,799,341 A 9/1998 Rodas
5,911,516 A 6/1999 Chang
5,953,766 A 9/1999 Szoke
6,000,070 A 12/1999 Bonin
6,178,568 B1 1/2001 Boulieris
6,618,865 B1 9/2003 Kim

* cited by examiner

*Primary Examiner*—Charles E Phillips
(74) *Attorney, Agent, or Firm*—Edgar W. Averill, Jr.; Kenneth L. Green

(57) ABSTRACT

A combination toilet and bidet unit. The unit has a toilet base which is surrounded in front by a skirt portion of the base. A toilet bowl is supported by the base as are water control valves. A bidet water line leads from the valves, passes through the bowl and terminates in a nozzle within the bowl.

8 Claims, 2 Drawing Sheets

COMBINATION TOILET AND BIDET

CROSS REFERENCE TO RELATED APPLICATION

The present application is a Continuation In Part of U.S. patent application Ser. No. 11/138,822, filed May 25, 2005, which application is incorporated herein in its entirety by reference.

BACKGROUND OF THE INVENTION

The field of the invention is plumbing fixtures and the invention relates more particularly to bidets. Bidets are most commonly provided as a separate fixture adjacent a conventional toilet. This requires a substantial amount of space and most commonly is not possible for use as an add-on in an already existing bathroom.

Various combination toilet and bidets have been devised but have not been widely accepted for various reasons. U.S. Pat. No. 5,208,922 shows a combination toilet and bidet which utilizes a separate unit which sits on top of the toilet top surface and requires an elaborate retractable bidet portion extending from the rear of the toilet bowl area. Another set of designs utilize a spray nozzle which extends from the rear of the toilet bowl, such as that shown in U.S. Pat. Nos. 5,652,971; 5,271,104; 5,799,341; 5,953,766; 6,000,070; 6,178,568; and 5,025,511. Several units require installation in the toilet seat which can affect the overall comfort of the user, such as that shown in U.S. Pat. Nos. 4,653,126 and 5,911,516. A unit showing a spray nozzle extendable from the side of the bowl is shown in U.S. Pat. No. 5,097,539. An appropriate combination of ease of use, cost, comfort, and space saving has yet to be commercialized.

BRIEF SUMMARY OF THE INVENTION

The present invention is for a combination toilet and bidet utilizing a toilet which has a toilet base and a front skirt positioned around the front portion of the toilet base. A toilet bowl is supported by the toilet base and the front skirt. The top surface of the toilet extends outwardly from a rear portion of the bowl to a rear outer edge perimeter which has a downwardly extending flange. A bidet on/off control valve is held by the downwardly extending flange and has a valve control handle extending outwardly from the downwardly extending flange, thus being easily turned on and off by the user. The downwardly extending flange has an inner surface facing the toilet base and the flange inner surface is accessible from below the downwardly extending flange. A bidet on/off control valve is held along the inner surface of the downwardly extending flange. At least one water inlet line is connected to the bidet on/off water control valve. A bidet water line leads from the bidet on/off water control valve through the bowl near a forward edge thereof and terminating within the bowl in a spray nozzle positioned within the bowl. Preferably, the unit has two water lines comprising a hot water line and a cold water line, which are mixed to provide warm water. Also preferably, the bidet water line leads from the bidet on/off control valve into the skirt cavity before entering the lower bowl near the forward portion thereof.

DETAILED DESCRIPTION OF THE INVENTION

Figure 1:
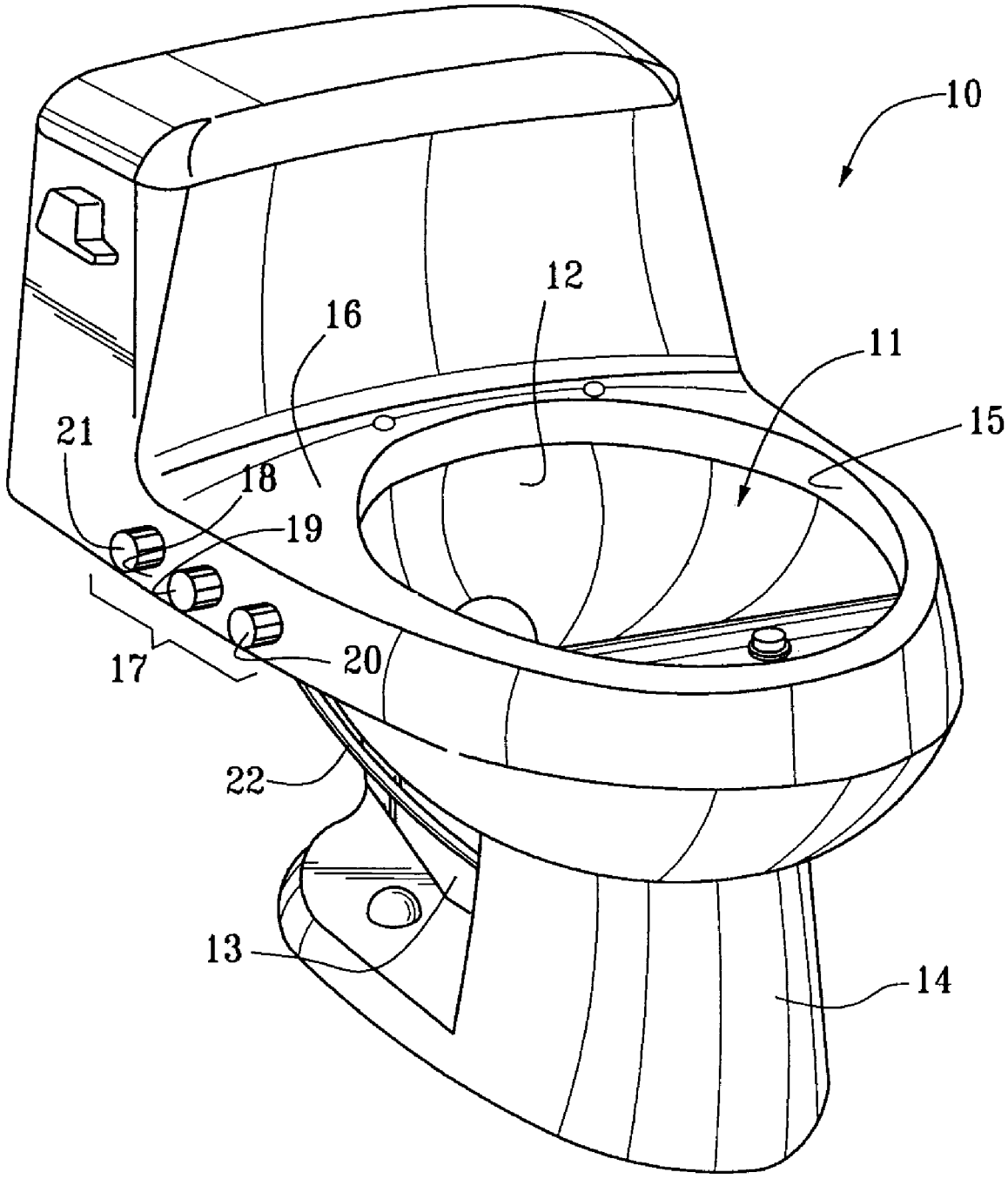
FIG. 1 shows a perspective view of the combination toilet and bidet of the present invention.
Figure 2:
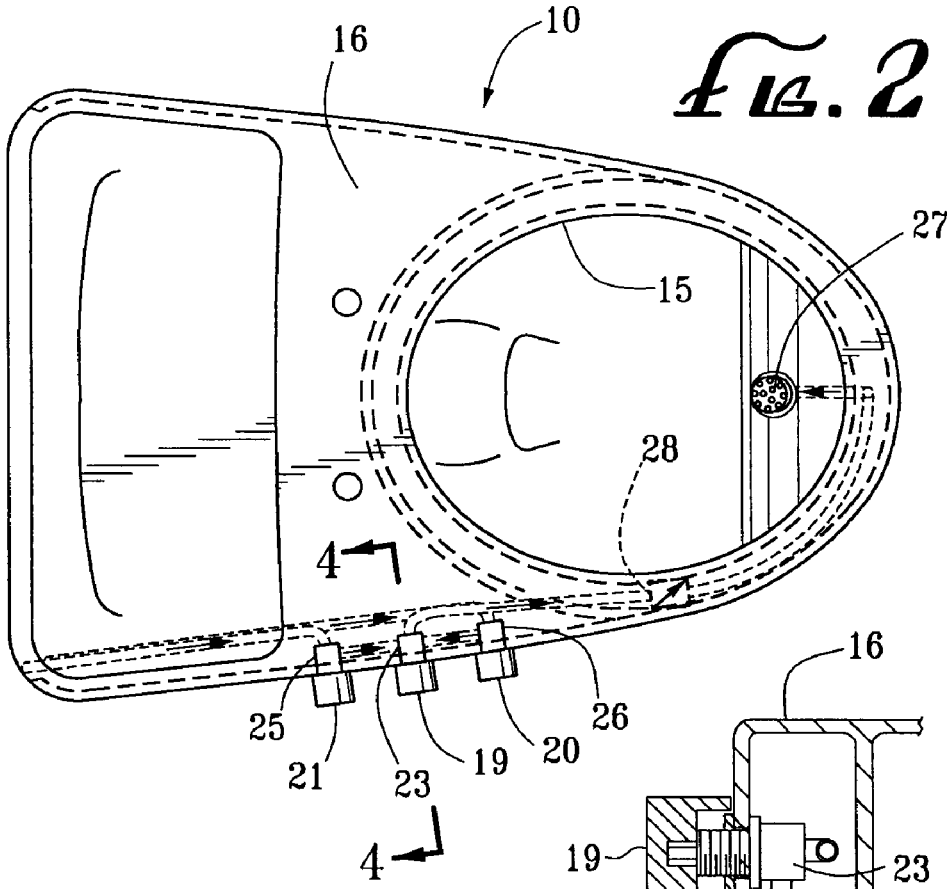
FIG. 2 is a top view thereof.

The toilet/bidet combination unit is shown in perspective view in FIG. 1 and indicated generally by reference character 10. Unit 10 has a bowl 11 with a forward portion 11, and a rearward portion 12. The bowl is supported by a toilet base 13 and a skirt 14 which surrounds the forward portion of base 13. The toilet has a rim 15 and a top surface 16. Top surface 16 extends outwardly and has an outer edge which extends to a downwardly extending flange 18. Reference character 17 represents an area of the downwardly extending flange 18, where handle 19 of a bidet on/off control valve is supported by a flange 18 at a location on a side of the bowl readily accessible to a seated user. Similiarly, a cold water handle and a hot water handle 21 are supported by flange 18 on either side of handle 19. A bidet water line 22 extends from a bidet on/off control valve shown best in FIG. 1. As shown best in FIG. 3, a hot water inlet line 24 feeds hot water valve 25 which has an outlet passing into bidet water control valve 23. Cold water inlet line 26 has an outlet which feeds bidet on/off water control valve 23. The hot and cold water control valves can be used to adjust the temperature entering bidet water line 22 and exiting spray nozzle 27. A check valve 28 is positioned in line 22 to prevent any reverse flow of water in line 22.

Figure 4:
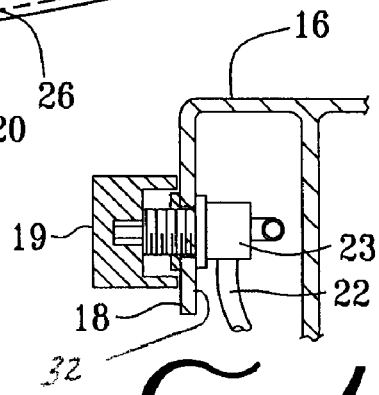
FIG. 4 is a cross-sectional view taken along line 4-4 of FIG. 2.

Downwardly extending flange 18 has an inner surface 32 and each of the valves, as shown by valve 23 in FIG. 4, is held against inner surface 32. The valves are accessible from below downwardly extending flange 18 as shown in FIG. 4.

Figure 3:
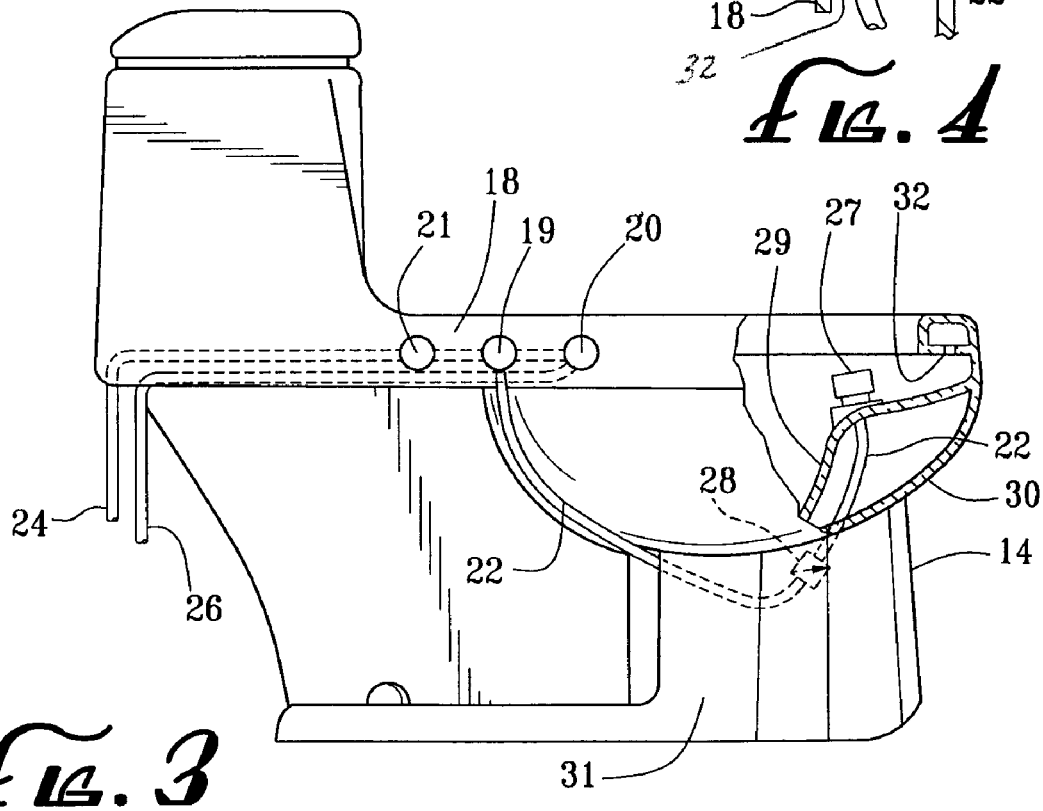
FIG. 3 is a side view thereof partially cut away.

As shown best in FIG. 3, bowl 11 has an inner bowl surface member 29 and a lower bowl outer surface portion 30.

Bidet water line 22 passes into skirt cavity 31 of front skirt 14, passes upwardly through lower bowl outer surface portion 30 and inner surface member 29. Inner surface member 29 supports spray nozzle 27. A cross section of rinse ring 32 is shown in FIG. 3 and operates in the conventional manner of a conventional toilet.

As a result, with only minor changes in a conventional toilet, a bidet unit can be added which is conveniently placed, easily operated, and visually unobtrusive. The toilet of course supports a conventional seat and lid (not shown) but does not require any modification of either of these parts. While a three valve unit is shown in the drawings, it is to be understood that the unit may be operated simply with control valve 23 if a desire to control the outlet temperature is not utilized. The cost of adding the bidet unit is relatively inexpensive by the manufacturer, and the outward appearance of the unit is very conventional. The handles are preferably on the right hand side for the ease of operation by most persons.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A combination toilet and bidet comprising:

a toilet having a toilet base and a front skirt positioned around a front portion of said toilet base;

a toilet bowl supported by said toilet base and said front skirt, said toilet bowl having an upper terminus from which a toilet top surface extends outwardly from a rear portion of said bowl to a rear outer edge perimeter, said rear outer edge perimeter having a downwardly extending flange and having a flange inner surface facing said toilet base and said flange inner surface being accessible from below said downwardly extending flange;

a bidet on/off control valve held by said downwardly extending flange along said inner surface of said downwardly extending flange having a valve control handle extending outwardly from said downwardly extending flange, at a location on a side of said bowl, readily accessible by a seated user of said toilet and bidet;

at least one water inlet line connected to said bidet on/off water control valve;

a bidet water line leading from said bidet on/off water control valve through said bowl near a forward edge thereof and terminating within said bowl in a spray nozzle positioned within said bowl.

2. The combination toilet and bidet of claim 1 wherein there are two water inlet lines comprising a hot water inlet line and a cold water inlet line;

said hot water inlet line being connected to a hot water control valve held by said downwardly extending flange, said hot water control valve having a hot water outlet line connected to said bidet on/off water control valve; and said cold water inlet line being connected to a cold water control valve held by said downwardly extending flange, said cold water control valve having a cold water outlet line connected to said bidet on/off water control valve.

3. The combination toilet and bidet of claim 1 wherein said bidet on/off control valve is held on the right side of said combination toilet and bidet.

4. The combination toilet and bidet of claim 2 wherein said bidet on/off control valve and said hot water control valve and said cold water control valve are held on the right side of said combination toilet and bidet.

5. A combination toilet and bidet comprising:

a toilet having a bowl having an inner bowl surface member which extends upwardly past a rinse ring, the upper portion of which forms a part of the toilet top surface, a portion of said toilet top surface extending outwardly from said rinse ring at a back portion of said rinse ring to form an outwardly extending portion of said top surface, said outwardly extending portion of said top surface terminating in a downwardly extending flange and having a flange inner surface facing said toilet base and said flange inner surface being accessible from below said downwardly extending flange, said bowl being supported by a toilet base and a front skirt, said front skirt extending forwardly from said toilet base to form a skirt cavity, said inner bowl surface member being formed with a forward mound positioned above a lower bowl outer surface portion to create a forward cavity;

a bidet on/off water control valve held by said downwardly extending flange along said inner surface of said downwardly extending flange having a control handle extending outwardly from said downwardly extending flange and a valve body positioned by an inner surface of said downwardly extending flange at a location on a side of said bowl, readily accessible by a seated user of said toilet and bidet;

at least one water inlet line connected to said bidet on/off water control valve;

a bidet water line leading from said bidet on/off water control valve into said skirt cavity, upwardly through said lower bowl outer surface portion, through said inner bowl surface member and terminating in a spray nozzle positioned above said inner bowl surface member.

6. The combination toilet and bidet of claim 5 wherein said bidet water line extends from said bidet on/off water control valve, outwardly along an outer surface portion of said bowl and into said skirt cavity near a connection line between said bowl and said toilet base.

7. The combination toilet and bidet of claim 5 wherein said bidet on/off water control valve is positioned near an upper end of an intersection of said bowl and said front skirt.

8. The combination toilet and bidet of claim 7 wherein said hot water control valve is positioned rearwardly with respect to said bidet on/off water control valve and said cold water control valve is positioned forwardly with respect to said bidet on/off water control valve.

* * * * *